US012703942B2

(12) United States Patent
Zong et al.

(10) Patent No.: US 12,703,942 B2
(45) Date of Patent: Aug. 11, 2026

(54) HYDROPHOBIC AND OLEOPHOBIC COATING, PREPARATION METHOD THEREFOR, AND PRODUCT

(71) Applicant: JIANGSU FAVORED NANOTECHNOLOGY CO., LTD., Jiangsu (CN)

(72) Inventors: Jian Zong, Jiangsu (CN); Siyue Li, Jiangsu (CN)

(73) Assignee: JIANGSU FAVORED NANOTECHNOLOGY CO., LTD., Wuxi (CN)

( * ) Notice: Subject to any disclaimer, the term of this patent is extended or adjusted under 35 U.S.C. 154(b) by 637 days.

(21) Appl. No.: 18/040,313

(22) PCT Filed: Aug. 3, 2021

(86) PCT No.: PCT/CN2021/110275
§ 371 (c)(1),
(2) Date: Feb. 2, 2023

(87) PCT Pub. No.: WO2022/028412
PCT Pub. Date: Feb. 10, 2022

(65) Prior Publication Data

US 2023/0313444 A1 Oct. 5, 2023

(30) Foreign Application Priority Data

Aug. 3, 2020 (CN) ..... 202010766901.7
Aug. 3, 2020 (CN) ..... 202010766907.4

(51) Int. Cl.
*D06M 10/10* (2006.01)
*D06M 10/02* (2006.01)
(Continued)

(52) U.S. Cl.
CPC ..... *D06M 10/10* (2013.01); *D06M 10/025* (2013.01); *D06M 15/53* (2013.01);
(Continued)

(58) Field of Classification Search
CPC .... D06M 10/10; D06M 10/025; D06M 15/53; D06M 15/643; D06M 2101/06;
(Continued)

(56) References Cited

U.S. PATENT DOCUMENTS 6,582,823 B1 6/2003 Sakhrani et al.
2009/0263592 A1 10/2009 Liu et al.
(Continued)

FOREIGN PATENT DOCUMENTS

CN 101676997 3/2010
CN 102083880 6/2011
(Continued)

OTHER PUBLICATIONS

CN 107686986 machine translation (Year: 2018).*
(Continued)

*Primary Examiner* — Blaine Copenheaver
(74) *Attorney, Agent, or Firm* — pH IP Law

(57) ABSTRACT

Disclosed are a hydrophobic and oleophobic coating, a preparation method therefor and a product, wherein the hydrophobic and oleophobic coating is formed by the deposition of a perfluoropolyether or perfluoropolyether derivative on the surface of a substrate by means of PECVD, such that the hydrophobic and oleophobic properties of the surface of the substrate are improved by the perfluoropolyether or perfluoropolyether derivative coating. Further disclosed are a hydrophobic and oleophobic coating, a preparation method therefor and a product, wherein the hydrophobic and oleophobic coating comprises: at least a two-layer structure, one of the layers being formed by the plasma chemical vapor
(Continued)

deposition of one or more perfluoropolyethers or perfluoropolyether derivatives as raw materials, and the other layer being formed by the plasma chemical vapor deposition of a silane- or siloxane-containing raw material, thereby improving the hydrophobic and oleophobic properties of the surface of a substrate.

22 Claims, 2 Drawing Sheets

(51) Int. Cl.
*D06M 15/53* (2006.01)
*D06M 15/643* (2006.01)
*D06M 101/06* (2006.01)
*D06M 101/32* (2006.01)

(52) U.S. Cl.
CPC ..... *D06M 15/643* (2013.01); *D06M 2101/06* (2013.01); *D06M 2101/32* (2013.01); *D06M 2200/11* (2013.01); *D06M 2200/12* (2013.01)

(58) Field of Classification Search
CPC ..... D06M 2101/32; D06M 2200/11; D06M 2200/12; D06M 13/507; D06M 13/513; D06M 15/6436; D06M 10/08; D06M 13/165; B05D 1/62; B05D 5/083; C23C 16/0245; C23C 16/30; C23C 16/515; C09D 171/00; C08G 65/007
See application file for complete search history.

(56) References Cited

U.S. PATENT DOCUMENTS

| | | | |
|---|---|---|---|
| 2010/0009216 | A1 | 1/2010 | Liu et al. |
| 2014/0322455 | A1 | 10/2014 | Im et al. |
| 2015/0004861 | A1 | 1/2015 | Gervasi et al. |
| 2015/0240354 | A1 | 8/2015 | Han et al. |
| 2018/0325728 | A1 | 11/2018 | Weikart et al. |

FOREIGN PATENT DOCUMENTS

| | | |
|---|---|---|
| CN | 103724610 | 4/2014 |
| CN | 107686986 | 2/2018 |
| CN | 108883057 | 11/2018 |
| CN | 109536920 | 3/2019 |
| CN | 110049863 | 7/2019 |
| CN | 111348840 | 6/2020 |
| JP | 2009185316 A | 8/2009 |
| JP | 2010049782 A | 3/2010 |
| JP | 2018193548 A | 12/2018 |
| KR | 2015/100414 | 9/2015 |
| TW | 2015/46028 | 12/2015 |
| TW | 2019/05230 | 2/2019 |
| WO | WO 2022/028412 | 2/2022 |

OTHER PUBLICATIONS

Fomblin HC Classic, Solvay Solexis SpA, obtained from https://cdn.thomasnet.com/ccp/01092357/132599.pdf (Year: 2004).*
CN 103724610 English machine translation (Year: 2014).*
Extended European Search Report issued in European Patent Application No. 21854121.7, dated Aug. 24, 2023.
Office Action issued in Japanese Patent Application No. 2023-507681, dated Mar. 26, 2024.
PCT International Search Report and Written Opinion issued in International Application No. PCT/CN2021/110275, dated Oct. 22, 2021.

* cited by examiner

HYDROPHOBIC AND OLEOPHOBIC COATING, PREPARATION METHOD THEREFOR, AND PRODUCT

CROSS-REFERENCE TO RELATED APPLICATIONS

This application is the national phase of International Application No. PCT/CN2021/110275, filed on Aug. 3, 2021, which claims the priority to Chinese Patent Application No. 202010766901.7, filed on Aug. 3, 2020, and entitled "HYDROPHOBIC AND OLEOPHOBIC COATING, PREPARATION METHOD THEREFOR, AND PRODUCT", and to Chinese Patent Application No. 202010766907.4, filed on Aug. 3, 2020, and entitled "HYDROPHOBIC AND OLEOPHOBIC COATING, PREPARATION METHOD THEREFOR, AND PRODUCT", the contents of which are incorporated herein by reference in their entirety.

TECHNICAL FIELD

The present disclosure relates to the field of surface modification, and more particularly, to a hydrophobic and oleophobic coating formed by plasma chemical vapor deposition technology, a preparation method therefor and a product.

The present disclosure relates to the processing field of fabrics, and more particularly, to a hydrophobic and oleophobic coating formed by plasma chemical vapor deposition technology, a preparation method therefor and a product. The hydrophobic and oleophobic coating is suitable for improving the waterproof and oil repellent performances of fabrics.

BACKGROUND

Nowadays, hydrophobic and oleophobic products are continuously favored by consumers, and more and more researches on hydrophobicity and oleophobicity are also reported one after another. Among all, the most studied compounds are perfluorinated compounds (PFASs), which have been widely used in industrial production due to excellent thermal stability, hydrophobicity and oleophobicity thereof.

However, PFASs have characteristics of refractory degradation, easy bioaccumulation, and high toxicity, etc., and have become a new type of pollutant. Most of the degradation products of PFASs are perfluorooctanoic acid (PFOA) and perfluorooctane sulfonic acid (PFOS), which may cause reproductive, developmental, liver and immune system damages in animals. Perfluorooctanoic acid (PFOA) and perfluorooctane sulfonic acid (PFOS) also may induce tumors and bring adverse effects on human health. Because these perfluorinated compounds are difficult to degrade, many developed countries have promulgated the prohibition of the use of perfluorinated compounds containing long carbon chains, which undoubtedly limits the development and application of such hydrophobic and oleophobic coating technologies. How to achieve hydrophobic and oleophobic properties on fabrics while avoiding the environmental problems caused by the use of perfluorinated compounds has become a research hotspot in the field of hydrophobic and oleophobic coating in recent years.

Chinese patent application publication No. CN107558184A discloses a preparation method of a fabric hydrophobic and oleophobic agent. The raw materials used in this method are non-toxic and harmless, and are not irritating to the human body. However, in the synthesis process, the fabric needs to be soaked in the reaction kettle and the stirring tank, which is easy to cause uneven impregnation, and is not suitable for the application of large-sized fabric products.

Chinese patent application No. 2019105740043 discloses a fluorine-containing nano-polymer modified nickel-titanium alloy material with super hydrophobic and oleophobic properties and a preparation method thereof. The surface of the modified nickel-titanium alloy material has excellent superhydrophobicity, superoleophobicity. Chinese patent application No. 2018100098455 discloses a method for preparing superhydrophobic and superoleophobic thin film materials by means of initiated chemical vapor deposition. However, these superhydrophobic and superoleophobic materials utilize perfluorinated compounds such as perfluoroacrylates, perfluorosiloxanes, which undoubtedly limits the development and application of such hydrophobic and oleophobic coating technologies.

In recent years, there has been an increasing demand for hydrophobic and oleophobic materials, especially the hydrophobic and oleophobic properties on fabrics are particularly attractive to consumers. The fabric material treated with hydrophobic and oleophobic material is covered with a hydrophobic and oleophobic protective layer. This hydrophobic and oleophobic material is able to greatly reduce the surface free energy of the fabric surface, and is able to significantly reduce the surface tension of the fabric. When water and oil drop on the fabric, they will form spherical droplets under their own surface tension, instead of wetting the material. This hydrophobic and oleophobic material is able to form a shield on the surface, and is able to block all kinds of liquids and oils encountered in life. Fabrics with hydrophobic and oleophobic functions have become a new fashion of fabrics and have huge potential economic and social benefits.

Chinese patent application publication No. CN1824884A discloses a preparation method of a hydrophobic and oleophobic self-cleaning suit fabric. In this method, the surface of the fabric is firstly etched by low-temperature plasma technology, so that the surface has a certain electrostatic attraction, and then the hydrophobic and oleophobic material is adsorbed on the surface of the fabric by way of immersing or spraying. This preparation method is very cumbersome, takes a long time to process, and is not suitable for massive, large-scale production.

Chinese patent application No. 2018100098455 discloses a method for preparing a superhydrophobic and superoleophobic thin film material by initiated chemical vapor deposition for the first time. This method combines traditional liquid-phase free radical polymerization and chemical vapor deposition technologies. The initiator and the monomer needed for polymerization are vaporized and introduced into a chamber, and the initiator is induced to decompose at a relatively low heating temperature, so that the monomer is polymerized into a polymer film and deposited on the substrate. Compared with the traditional liquid phase preparation process, the thin film obtained by the CVD method is dense and uniform, is controllable in thickness, and is suitable for substrates of any material. This method requires the addition of low-temperature decomposition initiators, but most initiators require relatively high temperatures for initiation, which limits the use of initiators.

SUMMARY

One advantage of the present disclosure is to provide a hydrophobic and oleophobic coating, a preparation method therefor and a product. The hydrophobic and oleophobic coating is formed on a surface of a substrate by plasma enhanced chemical vapor deposition, to improve the hydrophobic and oleophobic properties of the substrate.

Another advantage of the present disclosure is to provide a hydrophobic and oleophobic coating, a preparation method therefor and a product, wherein a raw material used for the hydrophobic and oleophobic coating is perfluoropolyether or perfluoropolyether derivative.

Another advantage of the present disclosure is to provide a hydrophobic and oleophobic coating, a preparation method therefor and a product, wherein the perfluoropolyether may include K-type, Y-type, Z-type, D-type structures.

Another advantage of the present disclosure is to provide a hydrophobic and oleophobic coating, a preparation method therefor and a product, wherein the perfluoropolyether derivative may be a perfluoropolyether hydroxyl derivative (PFPE-OH) having at least one hydroxyl group.

Another advantage of the present disclosure is to provide a hydrophobic and oleophobic coating, a preparation method therefor and a product, wherein the perfluoropolyether derivative may be an amorphous perfluorinated homopolymer or copolymer of perfluoro-m-dioxane.

Another advantage of the present disclosure is to provide a hydrophobic and oleophobic coating, a preparation method therefor and a product, wherein the raw material perfluoropolyether or perfluoropolyether derivative used is an environment-friendly material, reducing environmental pollution.

In order to achieve at least one of the above advantages, one aspect of the present disclosure provides a hydrophobic and oleophobic coating, formed by depositing perfluoropolyether or perfluoropolyether derivative on a surface of a substrate by PECVD.

According to an embodiment of the hydrophobic and oleophobic coating, a structural formula of the perfluoropolyether includes K-type, Y-type, Z-type, D-type structures.

According to an embodiment of the hydrophobic and oleophobic coating, the K-type molecular formula is: $CF_3CF_2CF_2O[CF(CF_3)CF_2O]_nCF(CF_3)COF$, wherein n is a natural number greater than or equal to 1.

According to an embodiment of the hydrophobic and oleophobic coating, the K-type structural formula is:

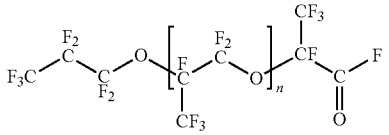

wherein n is a natural number greater than or equal to 1.

According to an embodiment of the hydrophobic and oleophobic coating, the Y-type molecular formula is: $CF_3O(C_3F_6O)_m(CF_2O)_nCF_3$, m is a natural number greater than or equal to 1, and n is a natural number greater than or equal to 1.

According to an embodiment of the hydrophobic and oleophobic coating, the Y-type structural formula is:

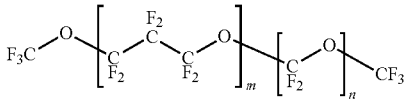

wherein m is a natural number greater than or equal to 1, and n is a natural number greater than or equal to 1.

According to an embodiment of the hydrophobic and oleophobic coating, the Z-type molecular formula is: $CF_3O(C_2F_4O)_m(CF_2O)_nCF_3$, wherein m is a natural number greater than or equal to 1, and n is a natural number greater than or equal to 1.

According to an embodiment of the hydrophobic and oleophobic coating, the Z-type structural formula is

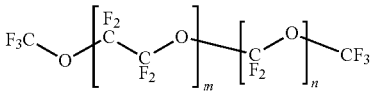

wherein m is a natural number greater than or equal to 1, and n is a natural number greater than or equal to 1.

According to an embodiment of the hydrophobic and oleophobic coating, the D-type molecular formula is: $C_3F_7O(CF_2CF_2CF_2O)_nC_2F_5$, wherein n is a natural number greater than or equal to 1.

According to an embodiment of the hydrophobic and oleophobic coating, the D-type structural formula is:

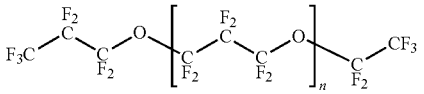

wherein n is a natural number greater than or equal to 1.

According to an embodiment of the hydrophobic and oleophobic coating, the perfluoropolyether has a formula $X_1—O(CFXO)_n(CFXCFXO)_m(CF_2CF_2CF_2O)_p(CF_2CF_2CF_2CF_2O)_q—X_2$ (I), wherein $—X_1$, $X_2$ are independently selected from molecular formulas $—(CF_2)_zCF_3$ and $CF(CF_3)COF$, wherein z is an integer from 0 to 3; X is the same or different at each occurrence, independently F or $CF_3$, n is an integer from 0 to 200; m is an integer from 0 to 200; p, q are integers from 0 to 100; p+q+m+n>0, and an average molecular weight of (I) is between 200 and 10,000.

According to an embodiment of the hydrophobic and oleophobic coating, the perfluoropolyether derivative is a perfluoropolyether hydroxyl derivative (PFPE-OH) having at least one hydroxyl group. The derivative PFPE-OH conforms to a formula $T_1$-O—Rf-$T_2$, wherein Rf is a fluoropolyoxyalkylene chain, and $T_1$ and $T_2$ are the same as or different from each other, and independently selected from formulas $—CF_2CH_2O(CH_2CH_2O)_s'H$ and $—CF_2CF_2CH_2O(CH_2CH_2O)_s''H$, wherein s' and s" are integers from 0 to 5.

According to an embodiment of the hydrophobic and oleophobic coating, the fluoropolyoxyalkylene chain Rf of the derivative PFPE-OH is a chain comprising repeating units $R^o$ selected from: (i) —CFXO—, wherein X is F or $CF_3$, (ii) —CFXCFXO—, wherein X is the same or different F or $CF_3$ at each occurrence, provided that at least one X is —F, (iii) $—CF_2CF_2CF_2O—$, (iv) $—CF_2CF_2CF_2CF_2O—$, (v) $—(CF_2)_j—CFZ—O—$, wherein j is an integer from 0 to 3 and Z is a group having a general formula of $—ORfT_3$, wherein Rf' is a fluoropolyoxyalkylene chain comprising from 0 to 10 numbers of repeating units, and $T_3$ is a $C_1$-$C_3$ perfluoroalkyl group.

According to an embodiment of the hydrophobic and oleophobic coating, the repeating unit $R^o$ in Rf' is selected from: —CFXO—, $—CF_2CFXO—$, $—CF_2CF_2CF_2O—$, $—CF_2CF_2CF_2CF_2O—$, each X is independently F or $CF_3$.

According to an embodiment of the hydrophobic and oleophobic coating, the perfluoropolyether or the perfluoropolyether derivative is selected from SOLVAY company's FLUOROLINK® MD 700, FLUOROLINK® D, Fluorolink® E10H, Fluorolink® PEG 45, Galden® SV55, Galden® HT 170, Galden® SV 80 RP06, Fomblin® Y L-VAC 16/6, Fomblin® Y, Fomblin® M100, or a mixture of more than one aforementioned products.

According to an embodiment of the hydrophobic and oleophobic coating, the perfluoropolyether or perfluoropolyether derivative is Novec fluorinated fluid of 3M company, or a mixture of one or more kinds of products containing perfluoropolyether or perfluoropolyetherderivative.

According to an embodiment of the hydrophobic and oleophobic coating, the perfluoropolyether derivative is a perfluoropolyether having at least one hydroxyl group or a perfluoropolyether having at least one carboxyl group or ester group.

According to an embodiment of the hydrophobic and oleophobic coating, a temperature range of the vapor deposition is 30-60 degrees.

Another aspect of the present disclosure provides a preparation method for a hydrophobic and oleophobic coating. The preparation method includes a step of with perfluoropolyether or perfluoropolyether derivative as a raw material forming by vapor deposition on a surface of a substrate by PECVD.

According to an embodiment of the preparation method for the hydrophobic and oleophobic coating, the perfluoropolyether derivative is a perfluoropolyether having at least one hydroxyl group or a perfluoropolyether having at least one carboxyl group or an ester group.

One advantage of the present disclosure is to provide a hydrophobic and oleophobic coating, a preparation method therefor and a product, which form a hydrophobic and oleophobic coating on a surface of a substrate by plasma enhanced chemical vapor deposition. The hydrophobic and oleophobic coating is more suitable for improving properties of the fabric surface.

Another advantage of the present disclosure is to provide a hydrophobic and oleophobic coating, a preparation method therefor and a product, wherein when the hydrophobic and oleophobic coating is formed on the surface of the fabric, the fabric does not need to be impregnated and the surface of the fabric does not need to be etched, simplifying the process and reducing damage to the fabric.

Another advantage of the present disclosure is to provide a hydrophobic and oleophobic coating, a preparation method therefor and a product, wherein the hydrophobic and oleophobic coating is a composite coating with a multi-layer structure, and a layer in contact with the fabric is formed by vapor deposition of one or more silanes, siloxanes or cyclosiloxanes, to improve hydrophobic properties of the substrate.

Another advantage of the present disclosure is to provide a hydrophobic and oleophobic coating, a preparation method therefor and a product, wherein another layer of the hydrophobic and oleophobic coating is formed by vapor deposition of perfluoropolyether or perfluoropolyether derivative, to improve oleophobic properties of the substrate.

Another advantage of the present disclosure is to provide a hydrophobic and oleophobic coating, a preparation method therefor and a product, wherein the hydrophobic and oleophobic coating is suitable for application on a surface of fabric containing 70% or more nylon material, and suitable for a clothing fabric containing 60% or more cotton material.

In order to achieve at least one of the above advantages, one aspect of the present disclosure provides a hydrophobic and oleophobic coating, including: at least two layers, wherein one layer is formed by plasma vapor deposition with one or more perfluoropolyether or perfluoropolyether derivative raw material, and another layer is formed by plasma vapor deposition of a silane- or siloxane-containing raw material.

According to an embodiment of the hydrophobic and oleophobic coating, a layer adjacent to a surface of a substrate is formed by depositing the silane- or siloxane-containing raw material.

According to an embodiment of the hydrophobic and oleophobic coating, an outer layer is formed by vapor deposition of the one or more perfluoropolyether or perfluoropolyether derivative raw material.

According to an embodiment of the hydrophobic and oleophobic coating, the silane- or siloxane-containing raw material is one or more selected from a group consisting of: vinyltrichlorosilane, 3-(methacryloyloxy)propyltrimethoxysilane, γ-aminopropyl triethoxysilane, γ-(2,3-glycidoxy) propyltrimethoxysilane, 3-aminopropyltrimethoxysilane, N-β-(aminoethyl)-γ-aminopropyl trimethoxysilane, N-β-(aminoethyl)-γ-aminopropylmethyldimethoxysilane, vinyltriethoxysilane, vinyltris(β-methoxyethoxy)silane, tetramethoxysilane, tetraethoxysilane, tetrapropoxysilane, allyltrimethoxysilane, hexamethyldisiloxane, tetramethyldisiloxane, hexaethyldisiloxane, 1,1,3,3-tetramethyldisiloxane, hexamethylcyclohexasiloxane, dodecamethylcyclohexasiloxane, octamethylcyclotetrasiloxane, decamethylcyclopentasiloxane, hexamethylcyclotrisiloxane, and hexadecylcyclooctasiloxane.

According to an embodiment of the hydrophobic and oleophobic coating, the perfluoropolyether or the perfluoropolyether derivative is one or more selected from a group consisting of: SOLVAY company's FLUOROLINK®-MD 700, FLUOROLINK® D, Fluorolink® E10H, Fluorolink® PEG 45, Galden® SV55, Galden® HT 170, Galden® SV 80 RP06, Fomblin® Y L-VAC 16/6, Fomblin® Y, Fomblin® M100, 3M company's Novec fluorinated fluid.

According to an embodiment of the hydrophobic and oleophobic coating, the hydrophobic and oleophobic coating is suitable for deposition on a surface of a fabric material, and the fabric material is one selected from nylon, polyester fiber, acrylic fiber, cotton.

According to an embodiment of the hydrophobic and oleophobic coating, the hydrophobic and oleophobic coating is suitable for deposition on a surface of a fabric containing 70% or more nylon material or a clothing fabric containing 60% or more cotton material.

According to an embodiment of the hydrophobic and oleophobic coating, the at least two layers are formed by successive multiple times of depositions during preparation.

Another aspect of the present disclosure provides a preparation method for a hydrophobic and oleophobic coating. The preparation method includes a step of performing plasma vapor deposition on a surface of a substrate for multiple times to form at least two layers, wherein one layer is formed by plasma vapor deposition of one or more perfluoropolyether or perfluoropolyether derivative raw material, and another layer is formed by plasma vapor deposition of a silane- or siloxane-containing raw material.

According to an embodiment of the preparation method for the hydrophobic and oleophobic coating, a layer contacting the surface of the substrate is formed by depositing the silane- or siloxane-containing raw material.

According to an embodiment of the preparation method for the hydrophobic and oleophobic coating, an outer layer is formed by vapor deposition of the one or more perfluoropolyether or perfluoropolyether derivative raw material.

DETAILED DESCRIPTION

Figure 1:
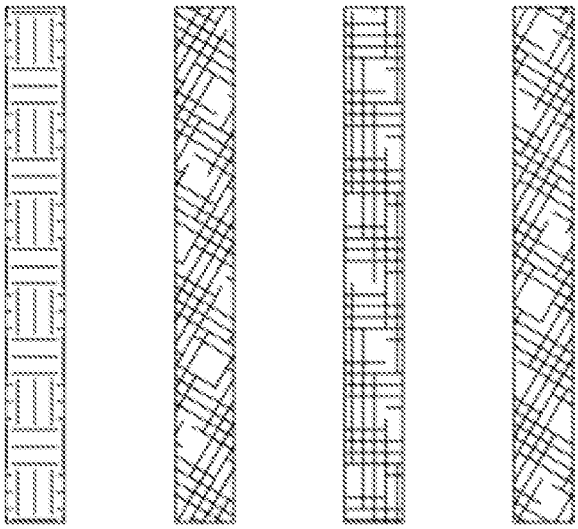
FIG. 1 is a schematic diagram of the test result of the waterproof grade according to a first embodiment of the present disclosure.

The following description serves to disclose the disclosure to enable those skilled in the art to practice the disclosure. The preferred embodiments described below are given by way of example only, and other obvious modifications will occur to those skilled in the art. The basic principles of the disclosure defined in the following description may be applied to other embodiments, variations, improvements, equivalents, and other technical solutions without departing from the spirit and scope of the disclosure.

It should be understood that the term "a", "one", "an" should be understood as "at least one" or "one or more". That is, in one embodiment, the number of an element may be one, while in another embodiment, the number of the element may be plural. The term "a", "one", "an" should not be understood as a limitation on the number.

References to "one embodiment," "an embodiment," "example embodiment," "various embodiments," "some embodiments," etc. indicate that such descriptions of embodiments of the disclosure may include a particular feature, structure, or characteristic, but not every embodiment necessarily includes that feature, structure, or characteristic. Furthermore, some embodiments may have some, all or none of the features described for other embodiments.

The disclosure discloses a hydrophobic and oleophobic coating, which is able to be formed on a surface of a substrate by PECVD (Plasma Enhanced Chemical Vapor Deposition). The hydrophobic and oleophobic coating is able to improve water-repellent and oil-repellent properties of the surface of the substrate.

Preferably, when preparing the hydrophobic and oleophobic coating, plasma vapor deposition is performed using an inert gas as a gas source, such as but not limited to argon, helium. That is, an inert gas is used as a pretreatment gas or a plasma source gas.

Preferably, when preparing the hydrophobic and oleophobic coating, the power supply of vacuum coating adopts a bias power supply, a radio frequency power supply or a microwave power supply. Optionally, a combination of the aforementioned two or three may be used.

Preferably, when preparing the hydrophobic and oleophobic coating, a raw material used for the hydrophobic and oleophobic coating is perfluoropolyether or perfluoropolyether derivative.

Further, the perfluoropolyether structural formula includes K-type, Y-type, Z-type, D-type structures.

The K-type molecular formula is: $CF_3CF_2CF_2O[CF(CF_3)CF_2O]_nCF(CF_3)COF$.

The K-type structural formula is:

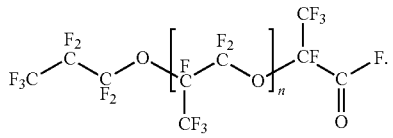

The Y-type molecular formula is: $CF_3O(C_3F_6O)_m(CF_2O)_nCF_3$.

The Y-type structural formula is:

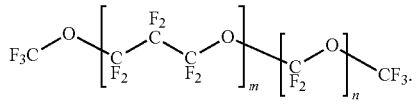

The Z-type molecular formula is: $CF_3O(C_2F_4O)_m(CF_2O)_nCF_3$.

The Z-type structural formula is:

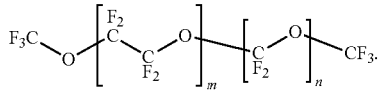

The D-type molecular formula is: $C_3F_7O(CF_2CF_2CF_2O)_nC_2F_5$.

The D-type structural formula is:

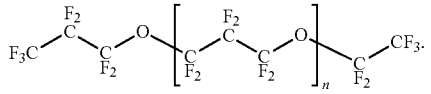

Wherein m and n are both natural numbers greater than or equal to 1.

The perfluoropolyether may also include the following formula: $X_1$—$O(CFXO)(CFXCFXO)_m(CF_2CF_2CF_2O)_p(CF_2CF_2CF_2CF_2O)_q$—$X_2$ (I), wherein —$X_1$, $X_2$ are independently selected from structural formulas —$(CF_2)_zCF_3$ and $CF(CF_3)COF$, wherein z is an integer from 0 to 3; X is the same or different at each occurrence, independently F or $CF_3$, n is an integer from 0 to 200; m is an integer from 0 to 200; p, q are integers from 0 to 100; p+q+m+n>0, and an average molecular weight of (I) is between 200 and 10,000.

Further, the perfluoropolyether derivative is a perfluoropolyether hydroxyl derivative (PFPE-OH) having at least one hydroxyl group, and the derivative PFPE-OH conforms to a chemical formula $T_1$-O—Rf-$T_2$, wherein Rf is a fluoropolyoxyalkylene chain, $T_1$ and $T_2$, the same as or different from each other, are independently selected from the formulae —$CF_2CH_2O(CH_2CH_2O)s'H$ and —$CF_2CF_2CH_2O(CH_2CH_2O)s''H$, wherein s' and s" are integers from 0 to 5.

The fluoropolyoxyalkylene chain Rf of the derivative PFPE-OH is a chain comprising repeating units $R^o$ selected from:

(i) —CFXO—, wherein X is F or $CF_3$, (ii) —CFXCFXO—, wherein X is the same or different at each occurrence and is F or $CF_3$, provided that at least one X is F, (iii) —$CF_2CF_2CF_2O$—, (iv) —$CF_2CF_2CF_2CF_2O$—, (v) —$(CF_2)_j$—CFZ—O—, wherein j is an integer from 0 to 3, and Z is a group having a general formula —ORfT$_3$, wherein Rf' is a fluoropolyoxyalkylene chain including from 0 to 10 numbers of repeating units, and the repeating units in Rf' are selected from: —CFXO—, —$CF_2$CFXO—, —$CF_2CF_2CF_2$O—, —$CF_2CF_2CF_2CF_2$O—, wherein each X is independently F or $CF_3$; and $T_3$ is a $C_1$-$C_3$ perfluoroalkyl group.

Further, the perfluoropolyether derivative may be an amorphous perfluorinated homopolymer or copolymer of perfluoro-m-dioxane. As shown in a structural formula, R'f is equal to RF or ORF, wherein RF is a linear or branched perfluoroalkyl group containing 1-5 carbon atoms; $X_1$ and $X_2$ are the same or different, and are F, $CF_3$.

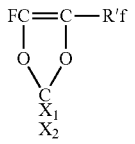

Mono/dicarboxylic acid perfluoropolyethers with acid and/or ester functional groups have a structural formula, A-O—$(RF)_z$—$(CFY)_t$—C(O)OX (II), wherein X is H, $C_1$-$C_{10}$ alkyl or aryl;

Y=F, $CF_3$;

t=1, 2 or 3;

A is a $C_1$-$C_4$ perfluoroalkyl end group or C(O)OX;

z=0 or 1; RF is a perfluorooxyalkylene chain comprising one or more of the following units statistically distributed along the backbone: ($C_3F_6$O); (CFYO), wherein Y is F or $CF_3$; ($CF_2CF_2$O); ($CF_2CF_2CF_2CF_2$O), with a number average molecular weight in a range of 180-8,000.

Further, the perfluoropolyether derivative may be a perfluoropolyether having at least one hydroxyl group or a perfluoropolyether having at least one carboxyl group or ester group.

It is worth mentioning that the hydrophobic and oleophobic coating is a coating with hydrophobic and oleophobic properties formed by depositing perfluoropolyether or perfluoropolyether derivative on a surface of a substrate by a low temperature plasma chemical vapor deposition. For example, a temperature range in the chamber during chemical vapor deposition is 30-60 degrees, which is more suitable for protecting the substrate and avoiding damage to the substrate caused by high temperature.

It is worth mentioning that the hydrophobic angle of the hydrophobic and oleophobic coating on a glass product is over 100 degrees, and the oleophobic angle of n-hexadecane is over 60 degrees. The hydrophobic and oleophobic coating may be used on glasses, mobile phone screens, electronic products, medical equipment, clothing fabrics, and fabrics as a hydrophobic and oleophobic layer or an anti-fingerprint layer.

The reagent used in the above-mentioned coating may be selected from SOLVAY company's FLUOROLINK® MD 700, FLUOROLINK® D, Fluorolink® E10H, Fluorolink® PEG 45, Galden® SV 55, Galden® HT 170, Galden® SV 80 RP06, Fomblin® Y L-VAC 16/6, Fomblin® Y, Fomblin® M100, or 3M company's Novec fluorinated fluid, or a mixture of various products containing perfluoropolyether or perfluoropolyether derivative.

According to an embodiment of the present disclosure, a preparation process of the hydrophobic and oleophobic coating may be as follows: (1) placing a substrate with a clean surface in a reaction chamber of a plasma device, then continuously vacuumizing the reaction chamber to reach a vacuum degree of 1-200 mtorr; (2) performing a chemical vapor deposition on the substrate to prepare the coating: (a) introducing a plasma source gas (such as helium, argon, other inert gas), turning on pretreatment to pretreat the substrate, and generating plasma in the chamber using radio frequency discharge, microwave discharge or pulse discharge etc., in the chamber. The reaction raw material monomer may be introduced at the same time as the plasma source gas, or the substrate may be pretreated for 1-1800s after the plasma source gas is introduced and before the reaction raw material monomer is introduced according to requirements of process parameters; (b) setting the pressure and temperature in the vacuum reaction chamber, at the same time introducing a gaseous or vaporized reaction raw material monomer, starting the deposition plasma discharge to perform plasma chemical vapor deposition, adjusting the plasma generation power to 300-500 W, adjusting the chamber inner temperature to 30-60° C., after the reaction is completed, stopping feeding the reaction raw material monomer gas, and raising the chamber pressure to normal pressure. It is worth mentioning that, preferably, both the pretreatment plasma discharge and the deposition plasma discharge are performed by a pulse bias power supply in a constant power mode.

Further, when preparing the hydrophobic and oleophobic coating, process conditions used are: the discharge power supply adopts a constant power mode pulse bias power supply, the plasma source gas flow rate is 10-500 sccm, the pressure is constant at 10-200 mT, the monomer flow rate is 10-1000 ul/min, the coating power is 400-500 W, the frequency is 2 KHz-70 KHz, and the duty cycle is 5%-80%.

The disclosure discloses a hydrophobic and oleophobic coating, which is able to be formed on a surface of a substrate by PECVD (Plasma Enhanced Chemical Vapor Deposition). The hydrophobic and oleophobic coating is able to improve the water-repellent and oil-repellent properties of the surface of the substrate.

Further, the hydrophobic and oleophobic coating is suitable for improving hydrophobic and oleophobic properties of a fabric surface, that is, the substrate is preferably a fabric. The hydrophobic and oleophobic coating is deposited on a surface of the fabric by PECVD, without immersing the fabric or etching the surface of the fabric, so as to protect the material properties of the fabric itself.

Further, the hydrophobic and oleophobic coating is a composite coating comprising a multi-layer structure. The hydrophobic and oleophobic coating includes at least a first layer and a second layer. The first layer is a layer that is close to or directly in contact with the substrate, and the first layer and the second layer are respectively formed by PECVD.

Preferably, in one embodiment, the first layer is formed by means of low temperature plasma chemical vapor deposition of one or more silanes, siloxanes or cyclosiloxanes on a surface of a substrate, such as a fabric surface. The second layer is formed by depositing perfluoropolyether or perfluoropolyether derivative on a surface of the first layer. That is, after the first layer is deposited on the surface of the substrate, the second layer is deposited, thereby obtaining the hydrophobic and oleophobic coating of the multilayer structure.

Preferably, the first layer and the second layer of the hydrophobic and oleophobic coating of the multi-layer structure are continuously formed in a same reaction equipment, and the deposition of each layer is controlled under predetermined conditions. Optionally, in one embodiment, the first layer and the second layer are formed intermittently, that is, after one layer is deposited, the film performance test is performed, and then another layer is deposited, thereby obtaining multi-layer structure. It may be seen from the test process that the continuous manufacturing process is better than the intermittent manufacturing process. That is to say, when preparing the hydrophobic and oleophobic coating of the multi-layer structure, it is necessary to perform PECVD multiple times, and then each PECVD process may be performed continuously in a same equipment, or may be performed in stages, forming one layer after forming another layer. Preferably, multiple PECVD processes are carried out continuously in a same equipment, pre-treating once, then successively respectively feeding reaction raw materials corresponding to different layers, and controlling corresponding reaction conditions.

It is worth mentioning that the hydrophobicity of the substrate surface may be improved by the first layer of the hydrophobic and oleophobic coating, and the oleophobicity of the substrate surface may be improved by the second layer of the hydrophobic and oleophobic coating, thereby making the substrate have both good hydrophobicity and good oleophobic property.

Further, when preparing the hydrophobic and oleophobic coating, an inert gas, such as but not limited to helium, argon, is used as the plasma source gas for plasma vapor deposition. Or in other words, helium, argon are used as the plasma source gas, and helium or argon is introduced in advance during deposition, facilitating plasma generation in the reaction chamber.

Preferably, the hydrophobic and oleophobic coating is suitable for deposition on surfaces of fabrics, including woven, non-woven, or knitted fabric substrates. Fabric materials are one or more selected from: nylon, polyester fiber, acrylic fiber, cotton. Further, the hydrophobic and oleophobic coating is suitable for deposition on a surface of a fabric containing 70% or more nylon material and a clothing fabric containing 60% or more cotton material.

Further, when preparing the first layer, the silane or siloxane raw material used may be one or more of: vinyltrichlorosilane, 3-(methacryloyloxy)propyltrimethoxysilane, γ-aminopropyltriethyl oxysilane, γ-(2,3-glycidoxy)propyltrimethoxysilane, 3-aminopropyltrimethoxysilane, N-β-(aminoethyl)-γ-aminopropyltrimethoxysilane silane, N-β-(aminoethyl)-γ-aminopropylmethyldimethoxysilane, vinyltriethoxysilane, vinyltris(β-methoxyethoxy)silane, tetramethylsilane oxysilane, tetraethoxysilane, tetrapropoxysilane, allyltrimethoxysilane, hexamethyldisiloxane, tetramethyldisiloxane, hexaethyldisiloxane, 1,1,3,3-tetramethyldisiloxane, hexamethylcyclohexasiloxane, dodecamethylcyclohexasiloxane, octamethylcyclotetrasiloxane, decamethylcyclopentasiloxane, hexamethylcyclotrisiloxane, hexadecylcyclooctasiloxane.

When preparing the second layer of the hydrophobic and oleophobic coating, the perfluoropolyether or perfluoropolyether derivative raw material used is one or more kinds of SOLVAY company's FLUOROLINK® MD 700 (perfluoropolyether with ester group), FLUOROLINK® D (perfluoropolyether with hydroxyl group), Fluorolink® E10, Fluorolink® PEG 45, Galden® SV 55, Galden® HT 170 (perfluoropolyether), Galden® SV 80 RP06, Fomblin® Y L-VAC 16/6, Fomblin® Y, Fomblin® M100, or 3M company's Novec fluorinated fluid, or a mixture of various perfluoropolyether or perfluoropolyether derivative monomers. The second layer, i.e., the outer layer, is the layer in contact with the outside world.

FLUOROLINK® D has a formula: $HO—CH_2CF_2O(CF_2O)_m(CF_2CF_2O)_nCF_2CH_2—OH$, wherein m and n are integers.

Fluorolink® E10 has a formula: $HO—(CH_2CH_2O)_kCH_2CF_2O(CF_2O)_m(CF_2CF_2O)_nCF_2CH_2(OCH_2CH_2)_k—OH$, wherein m and n are integers, k=1, 2.

Galden® HT 170 has a formula: $CF_3O(CF_2—CF(CF_3)O)_n(CF_2O)_mCF_3$, wherein n/m=20, and has an average molecular weight of 450.

Fomblin® Y has a formula: $CF_3O(C_3F_6O)_n(CF_2O)_mCF_3$, wherein n/m=20.

According to an embodiment of the present disclosure, a preparation process of the hydrophobic and oleophobic coating may be as follows: (1) placing a substrate with a clean surface in a reaction chamber of a plasma device, and then continuously vacuumizing the reaction chamber to reach a vacuum degree of 1-2000 mtorr; (2) performing chemical vapor deposition on the substrate to prepare the coating: (a) introducing a plasma source gas (such as helium, argon, other inert gas), generating plasma in the chamber by means of radio frequency discharge, microwave discharge, pulse discharge or other discharge. The reaction raw material monomer and the plasma source gas may be introduced at the same time, or the substrate may be pretreated for 1-1800s after the plasma source gas is introduced, and before the reaction raw material monomer is introduced according to requirements of process parameters; (b) setting the pressure and the temperature in the vacuum reaction chamber, introducing the gaseous or vaporized reaction raw material monomer at the same time, adjusting the plasma generation power to 1~1000 W and the chamber temperature to 10~100° C. for plasma chemical vapor deposition, and after the reaction is completed, stopping feeding the reaction raw material monomer, and raising the chamber pressure to normal pressure.

Further, in one embodiment, process conditions when preparing the hydrophobic and oleophobic coating are controlled as follows: 1. the discharge power supply is a pulse bias power supply with a maximum power of 12 KW; 2. the discharge power supply adopts a constant power mode, the helium flow rate is 10-500 sccm, the pressure is constant at 10-500 mT, the monomer flow rate is 10-1000 ul/min, the coating power is 100-1000 W, the frequency is 50 Hz-80 KHz, and the duty cycle is 5%-80%.

Preferably, a preparation process control condition 1 during the deposition of the first layer is as follows: the discharge power supply adopts a pulse bias power supply in a constant power mode, the plasma source gas flow rate is 10-500 sccm, the pressure is constant at 10-500 mT, the monomer flow rate is 10-1000 ul/min, the coating power is 50 W-600 W, the frequency is 200 Hz-80 KHz, the duty cycle is 5-80%, the chamber temperature is 20-60° C., the evaporator temperature is 50-150° C., and the coating duration time is 60 seconds-18000 seconds. In one embodiment, a pretreatment process may be performed before the plasma chemical deposition of the first layer. That is, after the plasma source is supplied, the substrate is pretreated for 1-1800s by plasma discharge, and then according to required process parameters the reaction raw material is fed. The parameters of pretreatment are: the discharge power supply adopts a pulse bias power supply in a constant power mode, the plasma source gas flow rate is 10-500 sccm, the pressure is constant at 10-200 mtorr, the coating power is 50 W-600 W, the frequency is 200 Hz-80 KHz, the duty cycle is 5%-80%, the temperature inside the chamber is 20-60° C., and the pretreating time is 1 second-1800 seconds.

Preferably, a preparation process control condition 2 during the deposition of the second layer is: the discharge power supply adopts a pulse bias power supply in a constant power mode, the flow rate of helium gas is 10-500 sccm, the pressure is constant at 10-500 mT, the flow rate of monomer is 10-1000 ul/min, the coating power is 50 W-600 W, the frequency is 200 Hz-80 KHz, the duty cycle is 5-80%, the chamber temperature is 20-60° C., the evaporator temperature is 50-150° C., and the coating duration time is 60-18000 seconds. In one embodiment, a pretreatment process may be performed before the plasma chemical deposition of the second layer. That is, after the plasma source is introduced, the substrate on which the first layer has been deposited is subjected to pretreatment for 1-1800s by plasma discharge, and then the reaction raw material is fed according to requirements of the process parameter. Parameters of the pretreatment are: the discharge power supply adopts a pulse bias power supply in a constant power mode, the flow rate of the plasma source gas is 10-500 sccm, the pressure is constant at 10-200 mtorr, the coating power is 50 W-600 W, the frequency is 200 Hz-80 KHz, the duty cycle is 5%-80%, the internal temperature of the chamber is 20-60° C., and the pretreatment time is 1 second-1800 seconds.

Further, an oil repellency of a fabric is tested according to AATCC 118 "oil drainage: hydrocarbon resistance test", which is basically consistent with GB/T 19977 and ISO 14419. Eight kinds of homologous solvents with gradually decreasing surface tension are used as standard liquids. Test liquids of different grades drop on the surface of the finished fabric, and the surface wetting of the fabric is observed after 30s. If a test liquid does not wet the fabric, the corresponding grade is the oil-repellent grade of the tested fabric.

The water-repellent performance test of the fabric is based on AATCC 22 "Testing and Evaluation of the Water-repellent Performance of Fabrics-Water-staining Method" to determine the dynamic water-repellent property of the fabric. A fabric sample after waterproof and oil-proof treatment is fixed on a metal ring with a diameter of about 150 mm, and placed on a fixed frame with an angle of 45°. 250 mL of water from a glass funnel above the sample is poured quickly to ensure that the natural spraying is completed within 25-30s. The fixing ring is removed, the fabric is gently tapped horizontally while facing down. The surface wetness of the sample is observed, to evaluate the waterproof value.

Example 1

A glass wiped with alcohol was put into a reaction chamber of a plasma chamber, and the reaction chamber was continuously vacuumized to reach a vacuum degree of 20 mtorr; the plasma source gas helium was passed in at a flow rate of 50 sccm, and the temperature inside the chamber was 55° C. A plasma discharge was turned on to pretreat the substrate. The discharge power supply adopted a pulse bias power supply in a constant power mode, the power was 500 W, the pulse frequency was 50 KHz, the duty cycle was 10%, and the discharge time was 30 minutes.

Then, the monomer raw material was vaporized and introduced into the reaction chamber. The internal temperature of the chamber was 45° C., the monomer vaporization temperature was 90° C., the helium gas flow rate was 50 sccm, the pressure was constant at 80 mtorr, the monomer flow rate was 350 ul/min, the coating discharge was a pulse discharge, the discharge power supply adopted a pulse bias power supply in a constant power mode, the power was 400 W, the pulse frequency was 50 KHz, the duty cycle was 10%, and the discharge time in the coating stage was 160 seconds.

The monomer raw materials were respectively SOLVAY company's Fomblin® Y, FLUOROLINK® D, FLUOROLINK® MD 700, Galden® HT 170 and Fluorolink® PEG 45. After coating, the hydrophobic angle and the oleophobic angle were measured and are shown in Table 1. The oleophobic angle was measured with n-hexadecane.

TABLE 1

| Product | hydrophobic angle (°) | oleophobic angle (°) |
|---|---|---|
| Fomblin ® Y | 113 | 63 |
| FLUOROLINK ® D | 110 | 61 |
| FLUOROLINK ® MD 700 | 110 | 62 |
| Galden ® HT 170 | 110 | 61 |
| Fluorolink ® PEG 45 | 112 | 62 |

Example 2

A nylon strap was put into a reaction chamber of a plasma chamber, and the reaction chamber was continuously evacuated to reach a vacuum degree of 20 mTorr; a plasma source gas helium was passed in at a flow rate of 50 sccm, and the temperature inside the chamber was 55° C. A plasma discharge was turned on to pretreat the substrate. The discharge power supply adopted a pulse bias power supply in a constant power mode, the power was 500 W, the pulse frequency was 50 KHz, the duty cycle was 10%, and the discharge time was 30 minutes.

A monomer raw material Galden® HT 170 was then after vaporization introduced into the reaction chamber. The internal temperature of the chamber was 50° C., the monomer vaporization temperature was 100° C., the helium gas flow rate was 50 sccm, the pressure was constant at 80 mTorr, the monomer flow rate was 300 ul/min, the coating discharge was a pulse discharge, the discharge power supply adopted a pulse bias power supply in a constant power mode, the power was 450 W, the pulse frequency was 50 KHz, the duty cycle was 20%, and the coating duration time was 160 seconds.

After coating, the hydrophobic angle was measured to be 132°, and the oleophobic angle was measured with n-hexadecane to be 93°.

Example 3

A glass wiped with alcohol was placed in a vacuum coating chamber, and the reaction chamber was continuously evacuated to reach a vacuum degree of 80 mTorr; a plasma source gas helium was introduced, the flow rate was 50 sccm, and the internal temperature of the chamber was 55° C. The substrate was pretreated by turning on a plasma discharge. The discharge power supply was a pulse bias power supply in a constant power mode, with a power of 500 W, a pulse frequency of 50 KHz, a duty cycle of 10%, and a discharge time of 30 minutes.

Monomer raw materials dihydroxy perfluoropolyether derivative FLUOROLINK® D and perfluoropolyether Galden® HT 170 were subsequently mixed according to different mass ratios to obtain solutions. The solutions were vaporized and after vaporization were introduced into the reaction chamber. The internal temperature of the chamber was 45° C., the monomer vaporization temperature was 90°

C., the flow rate of helium was 50 sccm, the pressure was constant at 80 mTorr, the monomer flow rate was 400 ul/min, the coating discharge was a pulse discharge, the discharge power supply adopted a pulse bias power supply in a constant power mode, the power was 460 W, the pulse frequency was 50 KHz, the duty cycle was 20%, and the coating duration time was 160 seconds.

The proportions of different mixed raw materials are shown in the table below, and the hydrophobic angle and the oleophobic angle were measured after the coating was completed and shown in Table 2, in which the oleophobic angle was measured with n-hexadecane.

TABLE 2

| dihydroxy perfluoropolyether derivative mass percentage (%) | hydrophobic angle (°) | oleophobic angle (°) |
|---|---|---|
| 85 | 106 | 62 |
| 65 | 108 | 63 |
| 50 | 110 | 63 |
| 35 | 115 | 65 |
| 25 | 110 | 64 |

It is worth mentioning that in the above examples, glass and nylon straps were used as examples of the substrate, but in other embodiments, other products or materials could be used as the substrate, and the composite coating of the multi-layer structure could be applied to different types of substrates such as glasses, mobile phone screens, electronic products, medical equipment, clothing fabrics, and fabrics with dense surfaces, as a hydrophobic and oleophobic layer or an anti-fingerprint layer, the present disclosure is not limited in this respect.

It is also worth mentioning that in the prior art, perfluoropolyethers or perfluoropolyether derivatives are immersed and then heated and dried to form a film layer on a surface of a substrate. This process is relatively complicated and easy to causes damage to the substrate. In the technical solution of the present application, the perfluoropolyether or perfluoropolyether derivative is vapor-deposited on a surface of a substrate at a low temperature by plasma vapor deposition technology to form a coating, the manufacturing process is simpler, the substrate material is protected, and the good hydrophobic and oleophobic properties of the raw material is kept during coating formation.

Example 4

A strip material of 70% nylon 66 material was placed in a reaction chamber of a plasma chamber, and the reaction chamber was continuously vacuumized to reach a vacuum degree of 80 mtorr; helium gas was passed in at a flow rate of 50 sccm, and a plasma discharge was started to pretreat the substrate. The pretreatment discharge was a pulse discharge. The discharge power supply adopted a pulse bias power supply in a constant power mode, the power was 400 W, the pulse frequency was 50 KHz, the duty cycle was 10%, and the discharge time was 5 seconds.

Then, hexamethylcyclohexasiloxane was vaporized and introduced into the reaction chamber, the pressure was constant at 80 mTorr, the monomer flow rate was 300 ul/min, the coating discharge was a pulse discharge, the power was 400 W, the pulse frequency was 50 KHz, the duty cycle was 10%, the internal temperature of the chamber was 55° C., the monomer vaporization temperature was 110° C., and the coating duration time was 320 seconds.

Then, FLUOROLINK® D purchased from SOLVAY company after vaporization was introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 10%, the temperature inside the chamber was 50° C., the monomer vaporization temperature was 100° C., and the coating duration time was 160 seconds.

After the coating was completed, the chamber was filled with compressed air to restore the normal pressure. The strip material was taken out to test the static hydrophobic angle, static oleophobic angle, water resistance and oil resistance properties of the nylon strip material.

Figure 2:
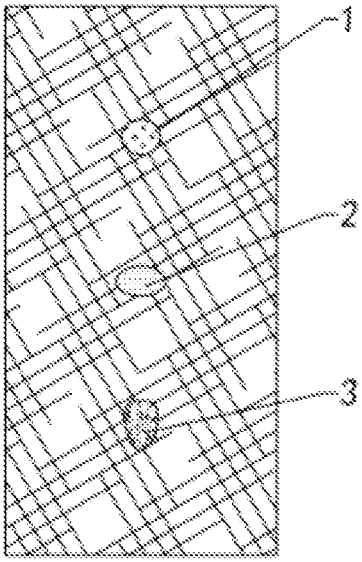
FIG. 2 is a schematic diagram of the test result of the oil repellency grade according to the first embodiment of the present disclosure.

The test results of the water-repellent grade could refer to FIG. 1, and the test results of the oil-repellent grade could refer to FIG. 2. In FIG. 2 1—indicates the test result of n-dodecane, 2—indicates the test result of n-tetradecane, and 3—indicates the test result of n-hexadecane. It can be seen from FIG. 1 that when the static hydrophobic angle test was performed on the nylon strip material, the material without the coating was obviously wetted, while the material with the coating was not wetted, and the waterproof grade reached grade 5.

The static hydrophobic angle on the nylon strip material was tested to be 143 degrees, and in the waterproof performance test of the nylon strip material, the sample surface was not wetted and had no water droplet, a water proof grade of grade 5.

In tests of the static oleophobic angle on the nylon strip material, the static oleophobic angle measured with n-hexadecane was 113 degrees, the oleophobic angle measured with n-tetradecane was 104 degrees, and the oleophobic angle measured with n-dodecane was 86 degrees, an oil-proof grade of grade 4.

Example 5

A polyester fiber clothing fabric was put into a reaction chamber of a plasma chamber, coating was carried out according to the method described in Example 4 above. The polyester fiber clothing fabric was tested after coating to obtain the static hydrophobic angle of the polyester fiber clothing fabric of 150 degrees.

Figure 3:
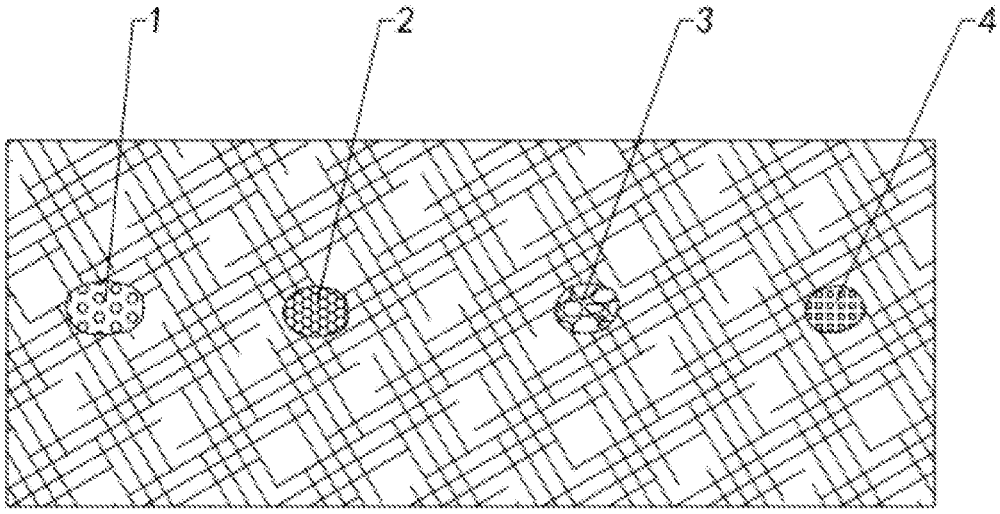
FIG. 3 is a schematic diagram of the test result of the oil repellency grade according to a second embodiment of the present disclosure.

The oleophobic angle of the polyester fiber clothing fabric was measured with an olive oil to be 120 degrees, measured with salad oil to be 123 degrees, and measured with sunflower oil to be 123 degrees. FIG. 3 may be referred to, in FIG. 3, 1—water, 2—olive oil, 3—salad oil, and 4—sunflower oil.

According to the test method described above, the waterproof and oil-proof grades were tested, with a waterproof grade of grade 5 and an oil-proof grade of grade 4.

Example 6

A cotton material clothing fabric was put into a reaction chamber of a plasma chamber, coating was carried out according to the method described in Example 4 above. After coating the cotton material clothing fabric was tested to measure the static hydrophobic angle of the cotton clothing fabric to be 140 degrees, with a waterproof grade of grade 5. The static oleophobic angle measured with n-hexadecane was 111 degrees, the oleophobic angle measured with n-tetradecane was 100 degrees, the oleophobic angle measured with n-dodecane was 83 degrees, and the oil-proof grade was grade 4.

Comparative Example of Example 4

Scheme (1) Only the first layer of the coating was deposited, the raw material was hexamethylcyclohexasiloxane, and a strip material of 70% nylon 66 material was placed in a reaction chamber of a plasma chamber. The reaction chamber was continuously vacuumized to reach a vacuum degree of 80 mtorr; helium gas was passed in, the flow rate was 50 sccm, a plasma discharge was started to pretreat the substrate. The pretreatment discharge was a pulse discharge, the power was 400 W, the pulse frequency was 50 KHz, the duty cycle was 10%, and the discharge time was 5 seconds.

Then, hexamethylcyclohexasiloxane was vaporized and introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 10%, the internal temperature of the chamber was 55° C., the monomer vaporization temperature was 110° C., and the coating duration time was 480 seconds.

After the coating was finished, the strip material sample was tested, the static hydrophobic angle was 155 degrees, and the static oleophobic angle measured with n-hexadecane was 0 degree. The waterproof grade was grade 5 and the oil-proof grade was grade 0.

Scheme (2) Only the second layer of the coating was deposited, and the raw material was SOLVAY company's FLUOROLINK® D. A strip material of 70% nylon 66 material was placed in a reaction chamber of a plasma chamber, and the reaction chamber was continuously evacuated to reach a vacuum degree of 80 mtorr; helium gas was introduced with a flow rate of 50 sccm, and a plasma discharge was started to pretreat the substrate. The pretreatment discharge was a pulse discharge. The discharge power supply adopted a pulse bias power supply in a constant power mode. The power was 400 W, the pulse frequency was 50 KHz, the duty cycle was 10%, and the discharge time was 5 seconds.

Then, FLUOROLINK® D purchased from SOLVAY company after vaporization was introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 10%, the temperature inside the chamber was 50° C., the monomer vaporization temperature was 100° C., and the coating duration time was 480 seconds.

After the coating was finished, the strip material sample was tested, the static hydrophobic angle was 135 degrees, the waterproof grade was grade 3, the static oleophobic angle measured with n-hexadecane was 115 degrees, measured with n-tetradecane was 105 degrees, and measured with n-dodecane was 86 degrees, and the oil-proof grade was grade 4.

Comparative Example of Example 5

Scheme (1) Only the first layer of the coating was deposited, the raw material A was hexamethylcyclohexasiloxane, a polyester fiber clothing fabric was placed in a reaction chamber of a plasma chamber, and the reaction chamber was continuously evacuated to reach a vacuum degree of 80 mTorr; helium gas was passed in, the flow rate was 50 sccm, a plasma discharge was started to pretreat the substrate, the pretreatment discharge was a pulse discharge, the power was 400 W, the pulse frequency was 50 KHz, the duty cycle was 10%, and the discharge time was 5 seconds.

Then, hexamethylcyclohexasiloxane was vaporized and introduced into the reaction chamber, the pressure was constant at 80 mTorr, the monomer flow rate was 300 ul/min, the coating discharge was a pulse discharge, the power was 400 W, the pulse frequency was 50 KHz, the duty cycle was 10%, the internal temperature of the chamber was 55° C., the monomer vaporization temperature was 110° C., and the coating duration time was 480 seconds.

After coating, the static hydrophobic angle of the clothing fabric was measured to be 155 degrees, the oleophobic angle measured with olive oil was 0 degree, the oleophobic angle measured with salad oil was 0 degree, and the oleophobic angle measured with sunflower oil was 0 degree. The waterproof and oil-proof grades were tested according to the above-mentioned test method, and the waterproof grade was grade 5, and the oil-proof grade was grade 0.

Scheme (2) Only the second layer of the coating was deposited, and the raw material B was SOLVAY company's FLUOROLINK® D. A polyester fiber clothing fabric was put in a reaction chamber of a plasma chamber, and the reaction chamber was continuously evacuated to reach a vacuum degree of 80 mtorr; helium gas was passed in, the flow rate was 50 sccm, a plasma discharge was started to pretreat the substrate, the pretreatment discharge was a pulse discharge. The discharge power supply adopted a pulse bias power supply in a constant power mode, the power was 400 W, the pulse frequency was 50 KHz, the duty cycle was 10%, and the discharge time was 5 seconds.

Then, FLUOROLINK® D purchased from SOLVAY company after vaporization was introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 10%, the temperature inside the chamber was 50° C., the monomer vaporization temperature was 100° C., and the coating duration time was 480 seconds.

After the coating was finished, the static hydrophobic angle of the polyester fiber clothing fabric was measured to be 140 degrees. The oleophobic angle measured with olive oil was 122 degrees, the oleophobic angle measured with salad oil was 124 degrees, and the oleophobic angle measured with sunflower oil was 124 degrees. According to the test method described above, the waterproof and oil-proof grades were tested, a waterproof grade of grade 3 and an oil-proof grade of grade 4.

Comparative Example of Example 6

Scheme (1) Only the first layer of the coating was deposited, the raw material A was hexamethylcyclohexasiloxane, and a cotton material clothing fabric was placed in a reaction chamber of a plasma chamber. The reaction chamber was continuously evacuated to reach a vacuum degree of 80 mTorr; helium gas was introduced at a flow rate of 50 sccm, and plasma discharge was turned on to pretreat the substrate, the pretreatment discharge was a pulse discharge, the power was 400 W, the pulse frequency was 50 KHz, the duty cycle was 10%, and the discharge time was 5 seconds.

Then, hexamethylcyclohexasiloxane was vaporized and introduced into the reaction chamber, the pressure was constant at 80 mTorr, the monomer flow rate was 300 ul/min, the coating discharge was a pulse discharge, the power was 400 W, the pulse frequency was 50 KHz, the duty cycle was 10%, the internal temperature of the chamber was 55° C., the monomer vaporization temperature was 110° C., and the coating duration time was 480 seconds.

After coating, the static hydrophobic angle of the clothing fabric was measured to be 145 degrees, and the static oleophobic angle measured with n-hexadecane was 0 degree. The waterproof and oil-proof grades were tested according to the above-mentioned test method, the waterproof grade was grade 5, and the oil-proof grade was grade 0.

Scheme (2) Only the second layer of the coating was deposited, and the raw material B was SOLVAY company's FLUOROLINK® D. A cotton material clothing fabric was put in a reaction chamber of a plasma chamber, and the reaction chamber was continuously vacuumized to reach a vacuum degree of 80 mTorr; helium gas was passed in at a flow rate of 50 sccm, and a plasma discharge was turned on to pretreat the substrate. The pretreatment discharge was a pulse discharge, the discharge power supply adopted a pulse bias power supply in a constant power mode, the power was 400 W, the pulse frequency was 50 KHz, the duty cycle was 10%, and the discharge time was 5 seconds.

Then, FLUOROLINK® D purchased from SOLVAY company after vaporization was introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 10%, the temperature inside the chamber was 50° C., the monomer vaporization temperature was 100° C., and the coating duration time was 480 seconds.

After the coating was finished, the static hydrophobic angle of the cotton material clothing fabric was measured to be 133 degrees. The static oleophobic angle measured with n-hexadecane was 113 degrees, the oleophobic angle measured with n-tetradecane was 101 degrees, and the oleophobic angle measured with n-dodecane was 85 degrees. According to the above test method the waterproof and oil-proof grades were tested, the waterproof grade was grade 3, and the oil-proof grade was grade 4.

Example 7

A strip material of 70% nylon 66 material was placed in a reaction chamber of a plasma chamber, and the reaction chamber was continuously evacuated to reach a vacuum degree of 50 mtorr; helium was introduced with a flow rate of 60 sccm, a plasma discharge was started to pretreat the substrate, and the pretreatment discharge was a pulse discharge. The discharge power supply adopted a pulse bias power supply in a constant power mode. The power was 400 W, the pulse frequency was 30 KHz, the duty cycle was 20%, and the discharge time was 30 seconds.

Then, the octamethylcyclotetrasiloxane was vaporized and introduced into the reaction chamber, the pressure was constant at 80 mTorr, the monomer flow rate was 300 ul/min, the coating discharge was a pulse discharge, the power was 400 W, the pulse frequency was 50 KHz, the duty cycle was 20%, the internal temperature of the chamber was 55° C., the monomer vaporization temperature was 110° C., and the coating duration time was 300 seconds.

Then, Galden® HT 170 purchased from SOLVAY company after vaporization was introduced into the reaction chamber, the pressure was constant at 80 mtorr, the monomer flow rate was 300 ul/min, the coating discharge was a pulse discharge, the power was 400 W, the pulse frequency was 50 KHz, the duty cycle was 20%, the internal temperature of the chamber was 50° C., the monomer vaporization temperature was 100° C., and the coating duration time was 200 seconds.

After the coating was completed, the chamber was filled with compressed air to restore the normal pressure. The strip material was taken out, and the static hydrophobic angle, static oleophobic angle, water resistance and oil resistance properties of the nylon strip material was tested.

The static hydrophobic angle on the nylon strip material was 147 degrees, and in the waterproof performance test of the nylon strip material, the tested surface was not wet and did have water droplets, with a waterproof grade of grade 5.

The static oleophobic angle of the nylon strip material was tested. The static oleophobic angle measured with n-hexadecane was 115 degrees, the oleophobic angle measured with n-tetradecane was 106 degrees, the oleophobic angle measured with n-dodecane was 87 degrees, and the oil-proof grade was grade 4.

Example 8

A cotton material clothing fabric was placed in a reaction chamber of a plasma chamber, and the reaction chamber was continuously evacuated to reach a vacuum degree of 80 mTorr; helium gas was introduced at a flow rate of 40 sccm, and a plasma discharge was turned on to pretreat the substrate. The pretreatment discharge was a pulse discharge. The discharge power supply adopted a pulse bias power supply in a constant power mode, the power was 460 W, the pulse frequency was 30 KHz, the duty cycle was 30%, and the discharge time was 60 seconds.

Then, tetramethoxysilane was vaporized and introduced into the reaction chamber, the pressure was constant at 80 mTorr, the monomer flow rate was 300 ul/min, the coating discharge was a pulse discharge, the power was 460 W, the pulse frequency was 50 KHz, the duty cycle was 30%, the internal temperature of the chamber was 55° C., the monomer vaporization temperature was 110° C., and the coating duration time was 300 seconds.

Then, FLUOROLINK® D purchased from SOLVAY company after vaporization was introduced into the reaction chamber, the pressure was constant at 80 mtorr, the monomer flow rate was 180 ul/min, the coating discharge was a pulse discharge, the power was 460 W, the pulse frequency was 50 KHz, the duty cycle was 30%, the temperature inside the chamber was 55° C., the monomer vaporization temperature was 100° C., and the coating duration time was 500 seconds.

After the coating was completed, the chamber was filled with compressed air to restore the normal pressure. The cotton material clothing fabric was taken out, and the static hydrophobic angle, static oleophobic angle, water resistance and oil resistance of the cotton material clothing fabric were tested.

In the test of the static hydrophobic angle on the cotton material clothing fabric, the static hydrophobic angle was 142 degrees, and in the test of the waterproof performance of the cotton material clothing fabric, the tested surface was not wet and did not have water droplets, a water-proof grade of grade 5.

In the test of the static oleophobic angle of the cotton material clothing fabric, the static oleophobic angle measured with n-hexadecane was 113 degrees, the oleophobic angle measured with n-tetradecane was 104 degrees, and the measured oleophobic angle with n-dodecane was 86 degrees, and the oil-proof grade was grade 4.

Example 9

A polyester fiber clothing fabric was placed in a reaction chamber of a plasma chamber, and the reaction chamber was continuously evacuated to reach a vacuum degree of 60 mtorr; argon was introduced with a flow rate of 50 sccm, a plasma discharge was started to pretreat the substrate, and the pretreatment discharge was a pulse discharge, the discharge power supply adopted a pulse bias power supply in a constant power mode, the power was 500 W, the pulse frequency was 30 KHz, the duty cycle was 15%, and the discharge time was 30 seconds.

Then, hexamethyldisiloxane was vaporized and introduced into the reaction chamber, the pressure was constant at 60 mTorr, the monomer flow rate was 300 ul/min, the coating discharge was a pulse discharge, the power was 500 W, the pulse frequency was 50 KHz, the duty cycle was 15%, the internal temperature of the chamber was 55° C., the monomer vaporization temperature was 110° C., and the coating duration time was 300 seconds.

Then, FLUOROLINK® D purchased from SOLVAY company after vaporization was introduced into the reaction chamber, the pressure was constant at 60 mTorr, the monomer flow rate was 180 ul/min, the coating discharge was a pulse discharge, the power was 500 W, the pulse frequency was 50 KHz, the duty cycle was 15%, the temperature inside the chamber was 55° C., the monomer vaporization temperature was 110° C., and the coating duration time was 300 seconds.

After the coating was completed, the chamber was filled with compressed air to restore the normal pressure. The polyester fiber clothing fabric was taken out, and tested on the static hydrophobic angle, static oleophobic angle, water resistance and oil resistance thereof.

According to the test of the static hydrophobic angle on the polyester fiber clothing fabric, the static hydrophobic angle was 142 degrees, and according to the test of the waterproof performance of the polyester fiber clothing fabric, the tested surface was not wet and did not have water droplets, a water-proof grade of grade 5.

According to the test of the static oleophobic angle of the polyester fiber clothing fabric, the static oleophobic angle measured with n-hexadecane was 116 degrees, the oleophobic angle measured with n-tetradecane was 107 degrees, the oleophobic angle measured with n-dodecane was 87 degrees, and the oil repellency grade was grade 4.

Example 10

A strip material of nylon 66 material was placed in a reaction chamber of a plasma chamber, and the reaction chamber was continuously evacuated to reach a vacuum degree of 80 mtorr; helium was fed with a flow rate of 50 sccm, a plasma discharge was started to pretreat the substrate, the pretreatment discharge was a pulse discharge, the discharge power supply adopted a pulse bias power supply in a constant power mode, the power was 500 W, the pulse frequency was 30 KHz, the duty cycle was 10%, and the discharge time was 100 seconds.

Then, 3-(methacryloyloxy)propyltrimethoxysilane was vaporized and introduced into the reaction chamber, the pressure was constant at 80 mTorr, the monomer flow rate was 350 ul/min, the coating discharge was a pulse discharge, the power was 500 W, the pulse frequency was 30 KHz, the duty cycle was 10%, the internal temperature of the chamber was 55° C., the monomer vaporization temperature was 110° C., and the coating duration time was 300 seconds.

Then, Fomblin® Y purchased from SOLVAY company after vaporization was introduced into the reaction chamber, the pressure was constant at 80 mtorr, the monomer flow rate was 350 ul/min, the coating discharge was a pulse discharge, the power was 500 W, the pulse frequency was 30 KHz, the duty cycle was 10%, the temperature inside the chamber was 55° C., the monomer vaporization temperature was 110° C., and the coating duration time was 300 seconds.

After the coating was completed, the chamber was filled with compressed air to restore the normal pressure. The strip material was taken out to test the static hydrophobic angle, static oleophobic angle, water resistance and oil resistance of the nylon strip material.

In the test of the static hydrophobic angle of the nylon strip material, the static hydrophobic angle was 140 degrees, and in the test of the waterproof performance of the nylon strip material, the tested surface was not wet and did not have water droplets, a waterproof grade of grade 5.

In the test of the static oleophobic angle of the nylon strip material, the static oleophobic angle measured with n-hexadecane was 108 degrees, the oleophobic angle measured with n-tetradecane was 100 degrees, the static oleophobic angle measured with n-dodecane was 83 degrees, and the oil-proof grade was grade 4.

It should be understood by those skilled in the art that the embodiments of the present disclosure shown in the above description and the accompanying drawings are only examples and do not limit the present disclosure. The objects of the present disclosure have been fully and effectively achieved. The functional and structural principles of the present disclosure have been shown and described in the embodiments, and the embodiments of the present disclosure may be varied or modified in any way without departing from the principles.

What is claimed is:

1. A hydrophobic and oleophobic coating, formed by plasma enhanced chemical vapor deposition (PECVD) on a surface of a substrate with a perfluoropolyether derivative or a mixture of perfluoropolyether and a perfluoropolyether derivative as a raw material, wherein the perfluoropolyether derivative is a perfluoropolyether having at least one hydroxyl group or a perfluoropolyether having at least one carboxyl or ester group.

2. The hydrophobic and oleophobic coating according to claim 1, wherein the perfluoropolyether includes structural formulas of K-type, Y-type, Z-type, or D-type structures.

3. The hydrophobic and oleophobic coating according to claim 1, wherein the perfluoropolyether has a formula $X_1$—$O(CFXO)_n(CFXCFXO)_m(CF_2CF_2CF_2O)_p(CF_2CF_2CF_2CF_2O)_q$—$X_2$ (I), wherein —$X_1$, $X_2$ are independently selected from structural formulas —$(CF_2)_zCF_3$ and $CF(CF_3)COF$, wherein z is an integer from 0 to 3; X is the same or different at each occurrence, and is independently For $CF_3$, n is an integer from 0 to 200; m is an integer from 0 to 200; p, q are integers from 0 to 100; p+q+m+n>0, and a number average molecular weight of (I) is between 200 and 10,000.

4. The hydrophobic and oleophobic coating according to claim 1, wherein the perfluoropolyether derivative is a perfluoropolyether hydroxyl derivative (PFPE-OH) having at least one hydroxyl group, the derivative PFPE-OH conforms to a formula $T_1$-O—Rf-$T_2$, wherein Rf is a fluoropolyoxyalkylene chain, $T_1$ and $T_2$ are the same as or different from each other and are independently selected from formulas —$CF_2CH_2O(CH_2CH_2O)_{s'}H$ and —$CF_2CF_2CH_2O(CH_2CH_2O)_{s''}H$, and wherein s' and s" are integers from 0 to 5.

5. The hydrophobic and oleophobic coating according to claim 4, wherein the fluoropolyoxyalkylene chain Rf of the derivative PFPE-OH is a chain comprising repeating units $R^o$ selected from: (i) —CFXO—, wherein X is F or $CF_3$, (ii) —CFXCFXO—, wherein X is the same or different F or $CF_3$ at each occurrence, provided that at least one X is —F, (iii) —$CF_2CF_2CF_2O$—, (iv) —$CF_2CF_2CF_2CF_2O$—, and (v) —$(CF_2)_j$—CFZ—O—, wherein j is an integer from 0 to 3 and Z is a group having a general formula —ORf'$T_3$, wherein Rf' is a fluoropolyoxyalkylene chain comprising from 0 to 10 numbers of repeating units, and $T_3$ is a $C_1$-$C_3$ perfluoroalkyl group.

6. The hydrophobic and oleophobic coating according to claim 5, wherein the repeating unit in Rf' is selected from a group consisting of: —CFXO—, —$CF_2CFXO$—, —$CF_2CF_2CF_2O$—, and —$CF_2CF_2CF_2CF_2O$—, wherein each X is independently F or $CF_3$.

7. The hydrophobic and oleophobic coating according to claim 1, wherein a temperature range of the vapor deposition is 30-60° C.

8. A preparation method for a hydrophobic and oleophobic coating, comprising: with a perfluoropolyether derivative or a mixture of a perfluoropolyether and a perfluoropolyether derivative as a raw material, forming the hydrophobic and oleophobic coating on a surface of a substrate by plasma enhanced chemical vapor deposition (PECVD), wherein the perfluoropolyether derivative is a perfluoropolyether having at least one hydroxyl group or a perfluoropolyether having at least one carboxyl or ester group.

9. The preparation method for the hydrophobic and oleophobic coating according to claim 8, wherein a preparation process of the hydrophobic and oleophobic coating is: (1) placing the substrate in a reaction chamber of a plasma chamber, and vacuumizing the reaction chamber to reach a vacuum degree of 10-200 mtorr; (2) introducing a plasma source gas, turning on a pretreatment plasma discharge to pretreat the substrate, (3) vaporizing the raw material, introducing the raw material into the reaction chamber, turning on a deposition plasma discharge to perform the chemical vapor deposition; (4) turning off the deposition plasma discharge, introducing compressed air or inert gas to restore normal pressure, opening the chamber, and taking out the substrate.

10. The preparation method for the hydrophobic and oleophobic coating according to claim 9, wherein the raw material and the plasma source gas is introduced at the same time, or the substrate is first subjected to 1-1800s pretreatment after the plasma source gas is introduced before feeding the raw material.

11. The preparation method for the hydrophobic and oleophobic coating according to claim 9, wherein the pretreatment plasma discharge and the deposition plasma discharge are both performed by a pulse bias power supply in a constant power mode.

12. A hydrophobic and oleophobic coating, comprising: at least two layers, wherein one layer is formed by plasma enhanced chemical vapor deposition with a perfluoropolyether derivative or a mixture of a perfluoropolyether and a perfluoropolyether derivative raw material, and another layer is formed by plasma enhanced chemical vapor deposition with a silane- or siloxane-containing raw material, wherein the perfluoropolyether derivative is a perfluoropolyether having at least one hydroxyl group or a perfluoropolyether having at least one carboxyl or ester group.

13. The hydrophobic and oleophobic coating according to claim 12, wherein a layer adjacent to a substrate surface is formed by plasma enhanced chemical vapor deposition with the silane- or siloxane-containing raw material.

14. The hydrophobic and oleophobic coating according to claim 12, wherein an outer layer is formed by plasma enhanced chemical vapor deposition of the perfluoropolyether derivative or the mixture of the perfluoropolyether and the perfluoropolyether derivative raw material.

15. The hydrophobic and oleophobic coating according to claim 12, wherein the silane- or siloxane-containing raw material is one or more selected from a group consisting of: vinyltrichlorosilane, 3-(methacryloyloxy) propyltrimethoxysilane, γ-aminopropyl triethoxysilane, γ-(2,3-glycidoxy) propyltrimethoxysilane, 3-aminopropyltrimethoxysilane, N-β-(aminoethyl)-γ-aminopropyl trimethoxysilane, N-β-(aminoethyl)-γ-aminopropylmethyldimethoxysilane, vinyltriethoxysilane, vinyltris(β-methoxyethoxy) silane, tetramethoxysilane, tetraethoxysilane, tetrapropoxysilane, allyltrimethoxysilane, hexamethyldisiloxane, tetramethyldisiloxane, hexaethyldisiloxane, 1,1,3,3-tetramethyldisiloxane, hexamethylcyclohexasiloxane, dodecamethylcyclohexasiloxane, octamethylcyclotetrasiloxane, decamethylcyclopentasiloxane, hexamethylcyclotrisiloxane, and hexadecylcyclooctasiloxane.

16. The hydrophobic and oleophobic coating according to claim 12, wherein the perfluoropolyether derivative has a formula HO—$CH_2CF_2O(CF_2O)_m(CF_2CF_2O)_nCF_2CH_2$—OH, wherein m and n are integers.

17. The hydrophobic and oleophobic coating according to claim 12, wherein the perfluoropolyether derivative has a formula HO—$(CH_2CH_2O)_kCH_2CF_2O(CF_2O)_m(CF_2CF_2O)_nCF_2CH_2(OCH_2CH_2)_k$—OH, wherein m and n are integers and k=1 or 2.

18. The hydrophobic and oleophobic coating according to claim 12, wherein the perfluoropolyether has a formula $CF_3O(CF_2—CF(CF_3)O)_n(CF_2O)_mCF_3$, wherein n/m=20, and has a number average molecular weight of 450.

19. The hydrophobic and oleophobic coating according to claim 12, wherein the perfluoropolyether has a formula $CF_3O(C_3F_6O)_n(CF_2O)_mCF_3$, wherein/m=20.

20. The hydrophobic and oleophobic coating according claim 12, wherein the hydrophobic and oleophobic coating is suitable for deposition on a surface of a fabric material selected from a group consisting of: nylon, polyester fiber, acrylic fiber, and cotton.

21. The hydrophobic and oleophobic coating according claim 12, wherein the hydrophobic and oleophobic coating is suitable for deposition on a surface of a fabric containing 70% or more nylon material or a clothing fabric containing 60% or more cotton material.

22. The hydrophobic and oleophobic coating according claim 12, wherein the at least two layers are formed by successive multiple times of depositions during preparation.

* * * * *